United States Patent [19]

Travisano

[11] Patent Number: 4,877,143

[45] Date of Patent: Oct. 31, 1989

[54] TAMPER EVIDENT INDICATING MEANS

[76] Inventor: Frank P. Travisano, 300 Buckelew Ave., Jamesburg, N.J. 08831

[21] Appl. No.: 207,458

[22] Filed: Jun. 16, 1988

[51] Int. Cl.[4] ..... B65D 55/02

[52] U.S. Cl. ..... 215/230; 116/270; 206/459; 206/807; 229/102

[58] Field of Search ..... 215/230; 206/807, 459; 229/102; 116/270

[56] References Cited

U.S. PATENT DOCUMENTS 3,703,879 11/1972 Huthsing ..... 116/270
3,736,899 6/1973 Manske ..... 215/230 X
4,747,497 5/1988 Holman ..... 215/230

*Primary Examiner*—Donald F. Norton
*Attorney, Agent, or Firm*—William P. Keegan

[57] ABSTRACT

A tamper evident indicating means for a vacuum packed package or bottle comprising an indicia printed seal that is separated from a translucent closure member when the package or bottle is under vacuum so that the indicia is not readable or discernible through the closure member, but when the vacuum is lost, as through tampering, the seal contacts the closure and the indicia printed thereon is readable or discernible to warn of possible tampering.

9 Claims, 1 Drawing Sheet

TAMPER EVIDENT INDICATING MEANS

FIELD OF THE INVENTION

The invention relates to tamper evident containers, and more particularly to a two piece indicator for such containers that provides an irreversible warning, either by printed message, mark, or color indication, when the integrity of the container has been violated, either intentionally or accidently. In either case, the intended user of the container or its contents will be warned that the container may have been tampered with.

BACKGROUND OF THE INVENTION

The food and beverage packaging industry has long been known to provide some indicating means to warn purchasers when the vacuum condition under which the food or beverage was packaged has been lost by failure of the closure seal. Such means may be a "pop top" closure of the type generally shown in U.S. Pat. No. 3,152,711 or in Patent No. 3,160,302. Patent No. 2,040,798 disclosed a tell-tale closure device for Mason jars or similar type containers which would indicate to a person whether or not the contents of the jars had been properly sealed during the "canning" process. The device would also indicate when the seal has been lost during storage of the processed products even though properly made initially during the "canning" process. Of course, the "pop top" closures and the Mason jar closure, in responding to loss of vacuum in the closed containers, would also indicate when that loss resulted from tampering, although that was not the principal purpose of the disclosures.

Another early closure arrangement is disclosed in Patent No. 2,880,900. Here a closure having an elastic inner diaphragm that, when the closure is applied to a product filled bottle in a vacuum packaging machine, distends inwardly to hold the contents of the bottle in place is disclosed. The arrangement is intended as a substitute for the cotton or crumpled paper dunnage that would otherwise be used to hold loose articles in place in a closed bottle.

A closure arrangement that is specifically intended as a tamper evident container is disclosed in Patent No. 4,519,515. Here, a disk seated atop the open neck of the container is coated at its top surface with microcapsules filled with a dye which changes color upon exposure to air. The capsules are ruptured, and the dye exposed to air, by the abrasive underside of the container cap when the cap is rotated to remove it from the container.

More recently, malicious tampering of product containers, especially containers of pharmaceutical products of the type such as headache and cold remedies normally displayed on store shelves has resulted in the disclosure of more elaborate tamper proof or tamper evident packages. Such tampering with hypodermic needles is a particularly insidious problem. For example, Patent No. 4,449,632 discloses a first container into which the product is placed, a second larger flexible container completely enclosing the first container but with a space between the two containers. The space between the two containers is filled with pressurized gas (or air) and an elastic layer or member is tightly stretched around the second container. If the package is violated as by a hypodermic needle penetrating both containers, or even just the second outer container, the pressurized gas is released and the elastic layer or member immediately squeezes the second container into contact with the first container. It is, for all intents and purposes, impossible for the person who violated the package to restore it to its initial condition. Thus, the collapsed second container provides a readily visible indication that the package has been tempered with. However, it is believed that the package is rather costly to manufacture and that it does not lend itself to convenient stacking and display on store shelves.

SUMMARY OF THE INVENTION

It an object of the invention to provide an improved taper evident indicator for containers.

It is another object of the invention to provide a tamper evident indicator for a container which will display a printed message, mark, or a color indication when the container is punctured with a hypodermic needle or otherwise invaded.

It is still another object of the invention to provide a tamper evident indicator that cannot be reestablished or reset after use to indicate an unopened container.

It is still another object of the invention to provide a tamper evident container that does not require additional packaging for the container.

It is yet another object of the invention to provide a tamper evident container that is relatively simple and easy to manufacture.

In carrying out the invention there is provided a two part tamper evident indicator comprising a first resilient element bearing a tamper evident message, mark, or color indication and a second element through which the message, mark, or color is clearly visible when both elements are adjacent to each other. When the indicator is placed on a vacuum sealed container, the resilient element is drawn away from the second element by the pressure differential between the vacuum inside the container and the ambient outside atmosphere, and the printed message, mark, or color indication on the resilient element is obscured so that it cannot be seen through the second element. Release of the vacuum within the container, either by opening the container, penetrating it with a hypodermic needle, or breaking the original seal in any way causes the resilient element to revert to contact with the second element so that its message, mark, or color indication becomes visible through the second element to indicate that the container has been opened or penetrated. The two part indicator may comprise a closure cap and an inner seal for a conventional bottle or container, such as a pill bottle. It may also form a part of the wall of a vacuum packaged bottle, carton, box, bag, or pouch, as well as a bag or pouch in a carton or box.

Features and advantages of the invention may be gained from the foregoing and from the description of a preferred embodiment of the invention which follows.

DETAILED DESCRIPTION OF THE INVENTION

Figure 1:
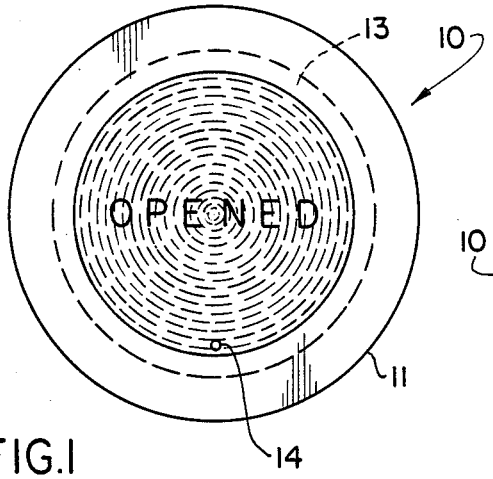
FIG. 1 is a top plan view of a tamper evident indicator according to the present invention.

In FIG. 1 a tamper evident indicator 10 for packages to indicate tampering therewith is shown having two components 11 and 12. The first component 11 is a rigid member formed, at least in its central portion, of a translucent material, while the second component 12 is a resilient member that is distendable or deformable when its opposite surfaces are subjected to a pressure differential. The resilient member may be a steel diaphragm similar to the "pop top" closures disclosed in the aforementioned and other prior art patents, or it may be formed of a gas impervious elastomeric material, as is preferred.

Resilient member 12 is secured along its periphery to member 11 by an annular adhesive coating 13, applied to either member, that hermetically joins the two members. A small aperture 14 is provided in member 11 so that an ambient pressure may be applied to the surface of member 12 adjacent to member 11. That same surface of member 12 will be printed with an indication of the condition of the package on which indicator 10 is provided. Thus, member 12 may be imprinted with a mark or the word "OPENED" thereon. Other suitable wording, which may be to the effect that the package contents are not to be used, may be preferred. Or, a color indication of the package condition may be provided.

Figure 3:
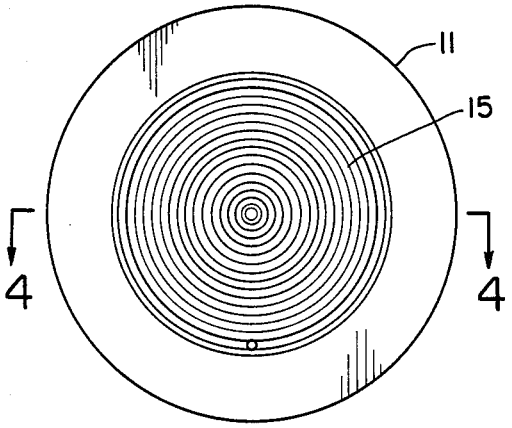
FIG. 3 is a view of one element of the tamper evident indicator.
Figure 4:
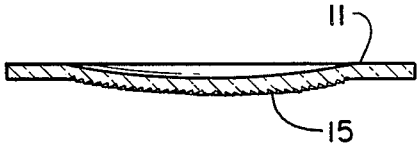
FIG. 4 is a sectional view taken along line 4—4 of FIG. 3.

Member 11, or at least that portion of it through which the printed indicia or color indication on member 12 may be seen, is a light diffusion element such that when member 12 is in contact with member 11 the indicia on member 12 is clearly visible and, if a printed message, readable. If the members are separated by as little as 3 mm. the indicia on member 12 will not be discernable, nor readable if in the form of a printed message. Thus, the surface of member 11 adjacent member 12 will be a light diffusion surface 15. This may take the form of a matte surface or a surface formed with a negative Fresnel lens as shown in FIGS. 3 and 4. The Fresnel lens embodiment is preferred since it is more efficient in transmitting light, and hence the warning indicia on member 12 will be more readily readable, especially by persons with vision problems.

Figure 5:
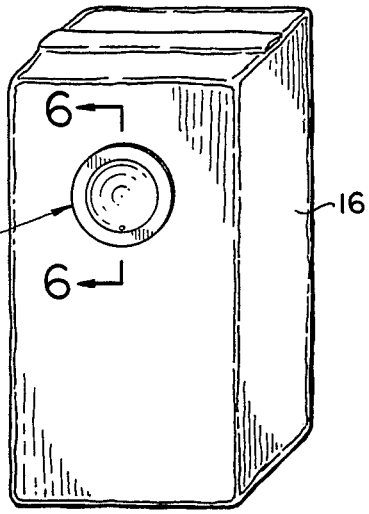
FIG. 5 is a perspective view of a vacuum sealed package embodying the tamper evident indicator of FIG. 1.
Figure 6:
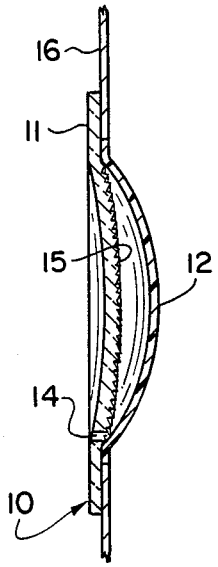
FIG. 6 is an enlarged sectional view taken along line 6—6 of FIG. 5.

In FIGS. 5 and 6, indicator 10 is shown on a vacuum sealed package 16. The package may be a rigid box with loosely packed contents, or the package contents may be foil wrapped, or in a bag or pouch, but in any case the package will be impervious to air. When used on a rigid box containing loosely packed contents, indicator 10 will be inserted in an aperture provided in package 16 and secured therein with an air-tight seal around its periphery. When the package is vacuum sealed, member 12 will be separated from member 11 because the inner surface of member 12 will be subjected to a vacuum while the surface adjacent member 11 will be at ambient pressure by virtue of aperture 14 provided in member 11.

Figure 2:
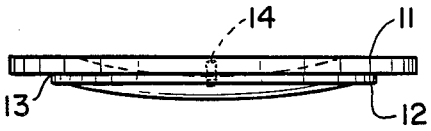
FIG. 2 is an elevational view of the tamper evident indicator.

In the case of a foil or plastic wrapped vacuum packaged product, such as coffee, indicator 10 would not initially be assembled as an integral unit as shown in FIGS. 1 and 2, and then applied to package 16. Rather, member 12, which may be formed of polyethylene terephthalate, would be secured in an air-tight manner across as aperture provided in the foil or plastic package. When the package is being filled with product, member 12 would be moved to and held in its distended shape (as shown in FIG. 6) by a convex section of the packaging mold as the package is being filled, e.g., with ground coffee. The mold will hold member 12 in its distended shape when the vacuum is applied and until the package is sealed, after which the mold can be removed. Member 12 will remain in its distended shape when the package is exposed to ambient pressure. Thereafter, member 11, formed of polystyrene, will be secured in place on the package in juxtaposition to member 12. The attachment of member 11 to package 16 need not be air-tight, and if it is not, aperture 14 will not be needed in member 11. If the product is packaged under a relatively high vacuum, member 12 may preferably be a resilient metal disk of tin plated steel about 0.005 inches thick.

Because of the separation of members 11 and 12, which is exaggerated in FIG. 6 for purposes of illustration, and the light diffusion surface 15 of member 11, a message printed on member 12 will not be visible to a person looking at the indicator. If, however, the vacuum within package 16 is lost, member 12 will revert to its undistended condition and the message printed thereon will be clearly discernable and readable through member 11. If the concern is about package tampering, that message may be "Warning-Package Has Been Opened." Of course, other suitable messages or marks may be used.

For frangible products vacuum packed in a pouch provided with an indicator 10, it may be desirable to place the pouch in a box or chipboard container. The pouch can be fastened, or glued to the box in a location to readily display indicator 10 through an aperture provided in the box.

Figure 7:
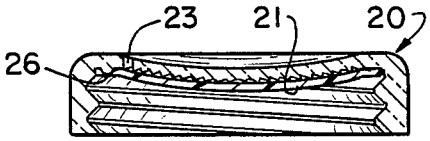
FIG. 7 is a sectional elevational view of a bottle closure according to the present invention.
Figure 8:
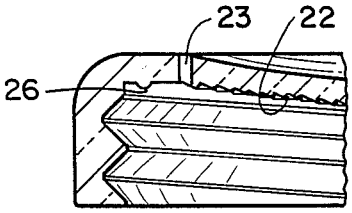
FIG. 8 is an enlarged fragmentary view of the FIG. 7 closure.
Figure 9:
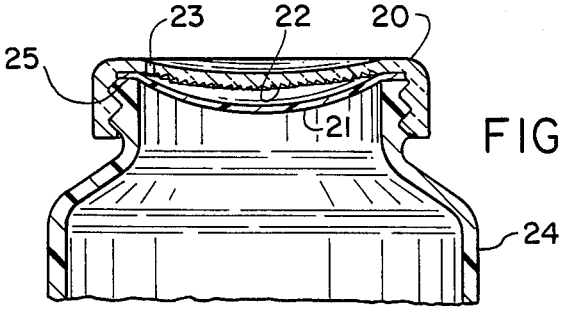
FIG. 9 is a sectional view showing the FIG. 7 closure on a vacuum sealed pill bottle.

In FIGS. 7 to 9 the tamper evident indicator is illustrated in the form of a closure 20 and a seal 21 for a bottle, e.g., a bottle for non-proprietary pharmaceutical pills sold from store shelves. Such bottles are often formed of a plastic material that can be penetrated by a hypodermic needle, and thus the contents thereof can be tampered with by such means as well as by removal of the bottle closure.

Closure 20 is formed as a conventional screw type closure, but at least its top is translucent and light diffusing. It may be molded from polystyrene. The light diffusing characteristic may be provided by forming the inner surface 22 of the closure with a Fresnel lens (FIG. 8). A small aperture 23 is provided as shown. The elastomeric seal 21, which may be made of polyethylene terephthalate, will have an appropriate message or color printed on the surface of the seal adjacent the inner surface of closure 20, and will be fitted into the closure. If the vacuum sealed bottle 24 (FIG. 9) on which closure 20 is placed will itself be blister packaged, seal 21 may simply be snap fitted into closure 20 just so that it will not fall out of the closure. If bottle 24 is not blister packaged, it would be a simple matter to remove closure 20 from the bottle and seal 21 from the closure, after which the closure 20, but not seal 21, could be restored to the bottle. In such case, the ultimate user would not know that the bottle was tampered with and the seal removed. Therefore, for non-blister packaged bottles, it would be preferable to adhesively secure seal 21 around its periphery to closure 20.

When the closure 20 and seal 21 are first applied to bottle 24 in a vacuum packaging machine and tightened so that the seal closes the mouth of the bottle in an air-tight manner, seal 21 will not be distended and separated from the inner surface of closure 20, but will be as shown in FIG. 7. To assure that seal 21 (whether snap fitted into closure 20 or adhesively secured thereto) does hermetically seal the mouth of bottle 24, the closure may be provided with an inwardly projecting sealing surface or bead 26, congruent with the top edge of the mouth of the bottle, that will act to press seal 21 tightly into contact with the top edge of the bottle mouth when the closure is threaded onto the bottle. Of course, a closure without bead 26 may be used provided seal 21 is pressed against the top edge of the bottle mouth to effect hermetic sealing of the bottle, or provided seal 21 is adhesively secured to the bottle to effect the desired seal. When the closed bottle leaves the packaging machine and is removed to the outside atmosphere, ambient air will enter through aperture 23 and cause seal 21 to separate from closure 20 as shown in FIG. 9. Thus, the message printed on seal 21 will not be readable through the top of closure 20. However, if the vacuum in bottle 24 is lost, as by penetrating the wall of the bottle with a hypodermic needle, seal 21 will revert to its non-distended shape as shown in FIG. 7, and its message will be clearly discernable through closure 20.

If a glass bottle is used in order to resist penetration by a hypodermic needle, it may be preferred to provide a resilient seal formed of a hardened steel diaphragm with a thickness of 0.005 to 0.008 inches, depending on the degree of vacuum available in the packaging equipment. The resilient seal may be bonded to the neck of the glass bottle by a polyethylene adhesive.

It might be preferred, when a relatively loose fitting screw closure is used on a bottle, that the seal 21 be hermetically secured across the mouth of the bottle with a suitable sealant 25. Such sealants are well known in the packaging art. Thus seal 21 will close the mouth of the bottle in an air-tight manner, and closure 20 will not have to be tightly screwed onto the bottle to press the seal into an air-tight contact with the mouth of the bottle. In such case it would not be necessary to provide aperture 23 in closure 20 since air at ambient pressure would leak between the "loosely fitted" threads of closure 20 and those of bottle 24 to cause seal 21 to take its distended shape as shown in FIG. 9. The same result would also occur if closure 20 was a snap type closure instead of the screw type closure illustrated since snap type closures inherently leak air.

Having thus described the invention, it is to be understood that many widely different embodiments thereof may be provided without departing from the spirit and scope of the invention. For example, a tamper evident indicator could be placed in an aperture formed in the sidewall of a glass or brittle plastic bottle which then would be provided with a conventional closure. Also, the diffusion surface of member 11 or closure 20 could be convex inwardly so as to intersect the plane established by the wall of package 16 or the mouth of bottle 24 to assure that there be intimate contact between that surface and member 12 or seal 21 when the message on member 12 or seal 21 is intended to be visible and readable. Also, the message may be printed in transferable ink so that when the vacuum is lost within the package 16 or bottle 24, the message will be transferred to member 11 or closure 20. In such case, the warning message cannot be removed by simply removing member 12 or seal 21. The invention may be adapted to packages and bottles sealed under positive pressure. In such case, the normal position of member 12 and seal 21 would be in contact with an outwardly convex member 11 and outwardly convex closure 20, respectively. The printed message would be appropriate to this circumstance. Loss of pressure in the package or bottle would cause member 12 or seal 21 to revert to a flat non-distended shape separated from the inner diffusion surface of member 11 or closure. The inability of the user to read the message printed on member 12 or seal 21 would be the warning that the package or bottle may have been tampered with. Thus, the foregoing specification and the accompanying drawing are to be interpreted as illustrative and not in a limiting sense.

What is claimed is:

1. A tamper-evident package for a vacuum packed consumer usable product, said package comprising: a container for the product, said container having an opening therein for a tamper-evident indicating means; a resilient diaphragm means, movable between a quiescent position and a flexed position, for sealing said opening, said diaphragm means being marked on its outer surface with warning indicia that indicates the container may have been tampered with; and a translucent closure means attached to said container adjacent said diaphragm means, said closure means having a light diffusing surface proximate to said warning indicia when said diaphragm means is in its quiescent position, the arrangement being such that said warning indicia on said diaphragm means is obscured and not visible through said closure means when said diaphragm means is flexed inwardly of said container and away from said closure means as a consequence of the vacuum within said container, and said warning indicia is visible through said closure means when said diaphragm means returns to its quiescent position proximate to said closure means when the vacuum within said container is lost.

2. A tamper-evident package according to claim 1 wherein said opening in said container defines a plane surface and wherein said light diffusing surface of said closure means is inwardly curved so that when said closure means is applied to said container said light diffusing surface extends below the plane defined by the edge of said opening in said container whereby intimate contact between said light diffusing surface and said diaphragm means is assured when the vacuum within said container is lost.

3. A tamper-evident package according to claim 1 wherein said closure means clamps said diaphragm means over said container opening.

4. A tamper-evident package according to claim 3 wherein said closure means is provided on its light diffusing surface with an inwardly projecting sealing surface congruent with the top edge of said container opening.

5. A tamper-evident package according to claim 3 wherein said closure means provided with an aperture whereby the outer surface of said diaphragm means is exposed to atmospheric pressure.

6. A tamper-evident package according to claim 1 wherein said diaphragm means is adhesively secured cover the opening of said container to thereby seal the container.

7. A tamper-evident package according to claim 6 wherein said closure means is provided with an aperture whereby the outer surface of said diaphragm means is exposed to atmospheric pressure.

8. A tamper-evident package according to claim 1 wherein a negative Fresnel lens forms said light diffusing surface of said closure means so that said warning indicia is obscured when there is a small spacing between said light diffusing surface and said diaphragm means.

9. A tamper-evident package according to claim 8 wherein the light diffusing surface of said closure means is inwardly curved so that when said closure means is applied to said container said light diffusing surface extends below the plane formed by the top edge of the mouth of said container whereby intimate contact between said light diffusing surface and said diaphragm is assured when the vacuum within said container is lost.

* * * * *